US006174234B1

(12) United States Patent
Seibert, Jr. et al.

(10) Patent No.: US 6,174,234 B1
(45) Date of Patent: Jan. 16, 2001

(54) PLAYER ACTIVATED MATCHING JACKPOT DEVICE

(75) Inventors: William E. Seibert, Jr., Beachwood; Robert C. Betti, Upper Saddle River, both of NJ (US)

(73) Assignee: H. Betti Industries, Inc., NJ (US)

( * ) Notice: Under 35 U.S.C. 154(b), the term of this patent shall be extended for 0 days.

(21) Appl. No.: 09/134,240

(22) Filed: Aug. 14, 1998

(51) Int. Cl.[7] ..... G07F 17/34; A63F 5/02
(52) U.S. Cl. ..... 463/20; 463/17; 273/143 R
(58) Field of Search ..... 273/143 R, 138.1, 273/138.2, 138 A; 463/20, 46, 17

(56) References Cited

U.S. PATENT DOCUMENTS

| | | | | |
|---|---|---|---|---|
| 4,618,150 | * | 10/1986 | Kimura | 273/143 R |
| 4,813,675 | * | 3/1989 | Greenwood | 273/138 A |
| 5,584,763 | | 12/1996 | Kelly et al. | 463/16 |
| 5,697,611 | * | 12/1997 | Kelly et al. | 273/126 A |
| 5,752,881 | * | 5/1998 | Inoue | 463/20 |

FOREIGN PATENT DOCUMENTS

| | | | | |
|---|---|---|---|---|
| 2191030 | * | 12/1987 | (GB) | 273/143 R |
| 2218558 | * | 11/1989 | (GB) | 273/143 R |

* cited by examiner

*Primary Examiner*—Benjamin H. Layno
(74) *Attorney, Agent, or Firm*—Sofer & Haroun, LLP

(57) ABSTRACT

A player activated matching jackpot device having a stop button for receiving signals from individual player during game play. The jackpot device is also provided with a plurality of character displays and a plurality of character lamps visibly arranged on the jackpot device, each character lamp corresponding to a character display. During game play the character lamps activate and deactivate one at a time in a predetermined pattern until the player presses the stop button, indicating a character corresponding to an illuminated character display. The jackpot device may also include reel devices, having a corresponding reel band to display each one of said characters sequentially. Each of the reel devices display a selected character in response to signals received from the stop button. Another reel device may also be added to randomly spin to an object character at start, middle, or end of game play and award points to the player who matches this character. The jackpot device advantageously includes a microprocessor that is configured to control and operate different components of the system. The combination of game characters selected by the player during game play corresponds to a value such that an award, such as a number of tickets or coins, is dispensed when a predetermined value or values is achieved. Various lights, scoring indicators and sounds may be added to the attraction and excitement of the game.

25 Claims, 6 Drawing Sheets

PLAYER ACTIVATED MATCHING JACKPOT DEVICE

FIELD OF THE INVENTION

This invention relates to amusement devices, and more particularly, to a microprocessor-based matching jackpot device.

BACKGROUND OF THE INVENTION

The entertainment industry continues to flourish as the public ceaselessly demands an increasing array of talent and innovation to help relax from the tumultuous reality, or simply to satisfy their specific wants. Particularly in today's technological computer era, arcade games and other electronic devices have become very popular. Entertainment centers have responded accordingly by installing new gaming devices, including casino-type games, and also converting classical amusement devices, such as pinball and poker, into digital counterparts.

Casino-type games and other entertainment forms that combine chance with skill have achieved a significant niche among a subset of society, both in the technological and traditional realm. Jackpot machines and other casino-type devices in their original form, however, rely almost entirely on chance to the extent that those who would otherwise have enjoyed the game concept are reluctant to subject themselves to these devices as they utilize no significant input from the player. Despite the advent of similar gaming devices that incorporate an element of skill into the game, there is still a need for a device that maintains the proper balance between user input and the inherent randomness of many casino games.

Moreover, even with the awe-inspiring profusion of such arcade games, the public, unsurprisingly, desires new forms of entertainment devices to spark its interest and excitement.

Thus there is a need for an amusement device that enables players to operate a casino-type arcade game utilizing different skills and offering a new type of entertainment from prior art in this field. In addition, this device would successfully incorporate an element of skill without significantly sacrificing the casino-type element of chance that many desire.

OBJECTS AND SUMMARY OF THE INVENTION

It is thus a general object of the present invention to provide a player activated matching jackpot device for play in amusement arcades, gaming casinos and homes.

A more specific object of the present invention is to provide a player activated matching jackpot device which inputs player's selections and which in turn provides a prize or award to the player.

It is another object of the invention to provide a microprocessor-based player activated matching jackpot device that is configured to provide a prize or award to the player based on a combination of characters selected by player from a plurality of flashing character lamps.

In accordance with one aspect of the present invention, a player activated matching jackpot device is provided and which comprises a plurality of unique character displays and a plurality of character lamps mounted in a visible pattern on the jackpot device, each character lamp corresponding to one of the unique characters. In one embodiment the character displays may each display a distinct character, while in another embodiment more than one character display may exhibit the same character. During game play the character lamps corresponding to each character display activate and deactivate one at a time in a predetermined pattern until the player presses a stop button, which selects a character corresponding to the character lamp being illuminated the instant the stop button was pressed. The player's objective is to select a winning combination of characters based on stop button signals from multiple rounds of game play. This winning combination may be predetermined in accordance with the game rules. In an alternative embodiment the winning combination may be modified while the game is in progress.

The game may also include a "slot machine" style mechanical reel device that displays at the start of game play a randomly selected "object" character. One of the objectives for a winning combination is to match successfully the user selected characters with this object character. Structurally, the reel device contains a reel band displaying all of the aforementioned unique characters and can be signaled by a control device, such as a microprocessor, to spin. In addition there may also be, alone or in combination with the above reel device, a plurality of other similar reel devices that are configured to spin to each of the game characters that the player selects during game play. In response to activation of the stop button, the reel band spins until the selected character is displayed via the reel device. These reel devices act both as an output mechanism, enabling the player to track his or her game, and as a display element, to partially simulate the appearance of a traditional jackpot machine.

Further, the game can be configured to operate only after receiving a predetermined quantity of coins from a coin entry mechanism. Also, as a reward for selecting a winning combination of characters, tickets are dispensed to be accumulated and traded in for a prize. Alternatively, the device of the present invention may be configured to award coins for additional games in lieu of tickets.

One or more LED displays may also be provided to display the current score, number of tickets earned, the "jackpot" value, or number of jackpot characters selected. In one embodiment the character "7" represents a jackpot character, the highest scoring character, whereas the LED display outputs the characters "7" each time the player successfully obtains this jackpot character during game play. Alternatively, the LED display can output the jackpot value, rather than the actual jackpot character selected. Also, other output devices, such as speakers and ornamental lights, are added to increase enjoyment of game play.

The game of the present invention is advantageously microprocessor-based, and is provided with various input and output ports to configure a lamp control board and a plurality of reel assemblies, among other devices. The lamp control board is coupled to each of the character lamps and possibly other lamps, such as reel lamps that illuminate their respective reel devices, allowing the microprocessor to signal each character lamp or reel lamp individually to activate or deactivate them.

With reference to the reel assemblies, each are coupled to one reel device. Each reel assembly includes a stepper motor to incrementally spin the characters on the reel band and an optic sensor to identify a marked position on the reel device to enable the microprocessor to calculate which character is currently being displayed on that particular reel device.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

DETAILED DESCRIPTION OF THE DRAWINGS

Figure 1:
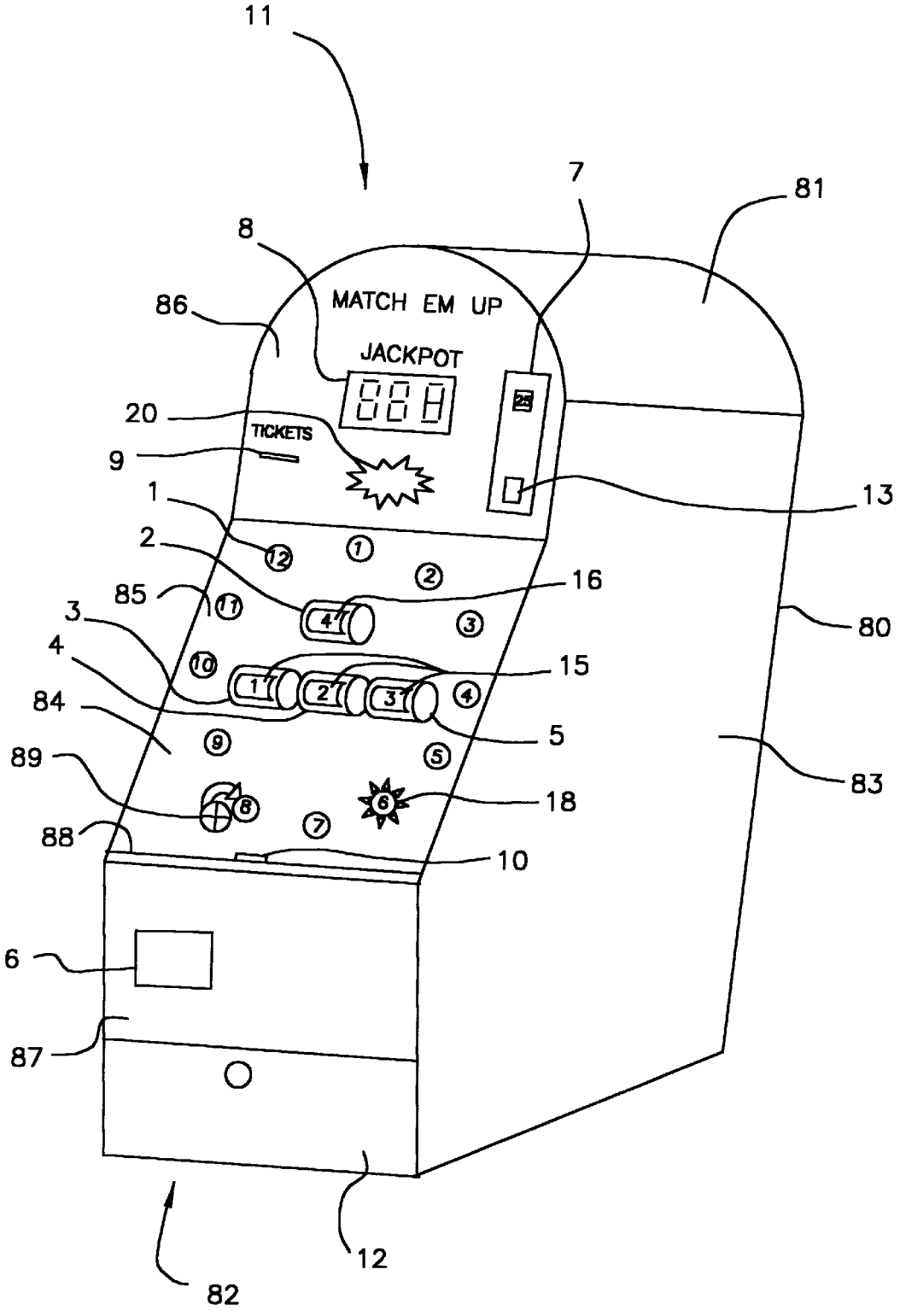
FIG. 1 illustrates a front perspective of the player activated matching jackpot device according to one embodiment of the present invention.

With initial reference to FIG. 1, a player activated matching jackpot device 11 is shown according to one embodiment of the present invention. Player activated matching jackpot device 11 is comprised of a housing 80 having a rounded top surface 81, a base 82 and a peripheral enclosing side wall 83. Player activated matching jackpot device 11 is further provided with a vertical front face 84, a vertical top front 86 having a rounded top to match rounded top surface 81 of housing 80, and a vertical bottom front 87. Vertical bottom front 87 is extended forward a measurable distance to enable a horizontal user platform 88 to be placed, connecting top of bottom front with bottom of front face. Front face 84 is comprised of a translucent plate, such as glass or clear plastic, whereas a front panel 85 is vertically disposed beneath front face 84 and is visible therethrough. Front panel 85 may include drawings or designs thereon to add elements of action and excitement.

Front panel 85 includes four "slot machine" style mechanical reel devices 2–5. Three "game character" reel devices 3–5 are disposed horizontally adjacent to each other at the center of front panel 84, and a fourth "object character" reel device 2 is positioned directly above the game character reel devices. Game character reel devices 3–5 and object character reel device 2, respectively contain a reel band 15 and 16 on which a number of unique characters are individually displayed. For example, in one embodiment of the invention, twelve unique characters are disposed consecutively to cover the entire reel bands 15 and 16. Once mounted on the front panel 85, the player is able to see only one character at any instant. Each of the four reel devices 2–5 preferably contain reel lamps 20 (FIG. 3) attached thereto, which turn on and illuminate the one visible character at selected moments of the game.

Front panel 85 further includes twelve character displays 1 positioned in a circular fashion around the reel devices 2–5. Each character display may include a translucent glass cover. Each of the twelve character displays 1 comprises a unique artwork corresponding to one of the twelve characters on the reel bands 15 and 16. A corresponding character lamp 18 (FIGS. 1 and 3) is employed to illuminate the character displays 1 at a desired sequence.

It should be noted that the reel devices, character lamps and characters are not limited to the configuration as illustrated in FIG. 1 and as recited hereinabove. For example, the number of characters and reel devices can be adjusted, the character displays and reel devices can be situated according to a different pattern, and the front face 84, along with front panel 85 may be positioned horizontally within housing. Furthermore, instead of character lamps, other visual indication units may be employed that provide a visual cue that corresponds to a character display, as will be explained below.

With continued reference to FIG. 1, peripheral enclosing side wall 83 of housing 80 may be configured in any of a variety of shapes including square, hexagonal, octagonal, etc., having the corresponding number of side walls. Similarly, housing 80 may be miniaturized to fit on a table top, and character lamps, character displays, and reel devices can also either be replaced with smaller parts or even computerized to allow a hand held or software version of player activated matching jackpot device.

Vertical top front 86 includes an award output slot 9 for distributing tickets or vouchers to players of the game. Alternatively the award output slot 9 may be designed to distribute tokens or other awards. A coin entry 7 and coin return 13 device may also be mounted on vertical top front 86 to charge for usage. A coin storage chamber 12 located on vertical bottom front 87 receives and stores coins inserted into coin entry 7. Coin storage chamber may be a door which opens into the housing 80, or a secure drawer which slides out from housing 80.

Output devices, such as a jackpot display 8, located on vertical top front 86, and speakers 6, located on vertical bottom front 87, can enhance the gaming environment by offering scoring and sound, respectively. Jackpot display 8 is an LED display with three characters. An input device stop button 10, is located on horizontal user platform 88 and enables the player to interact with the game.

Figure 2:
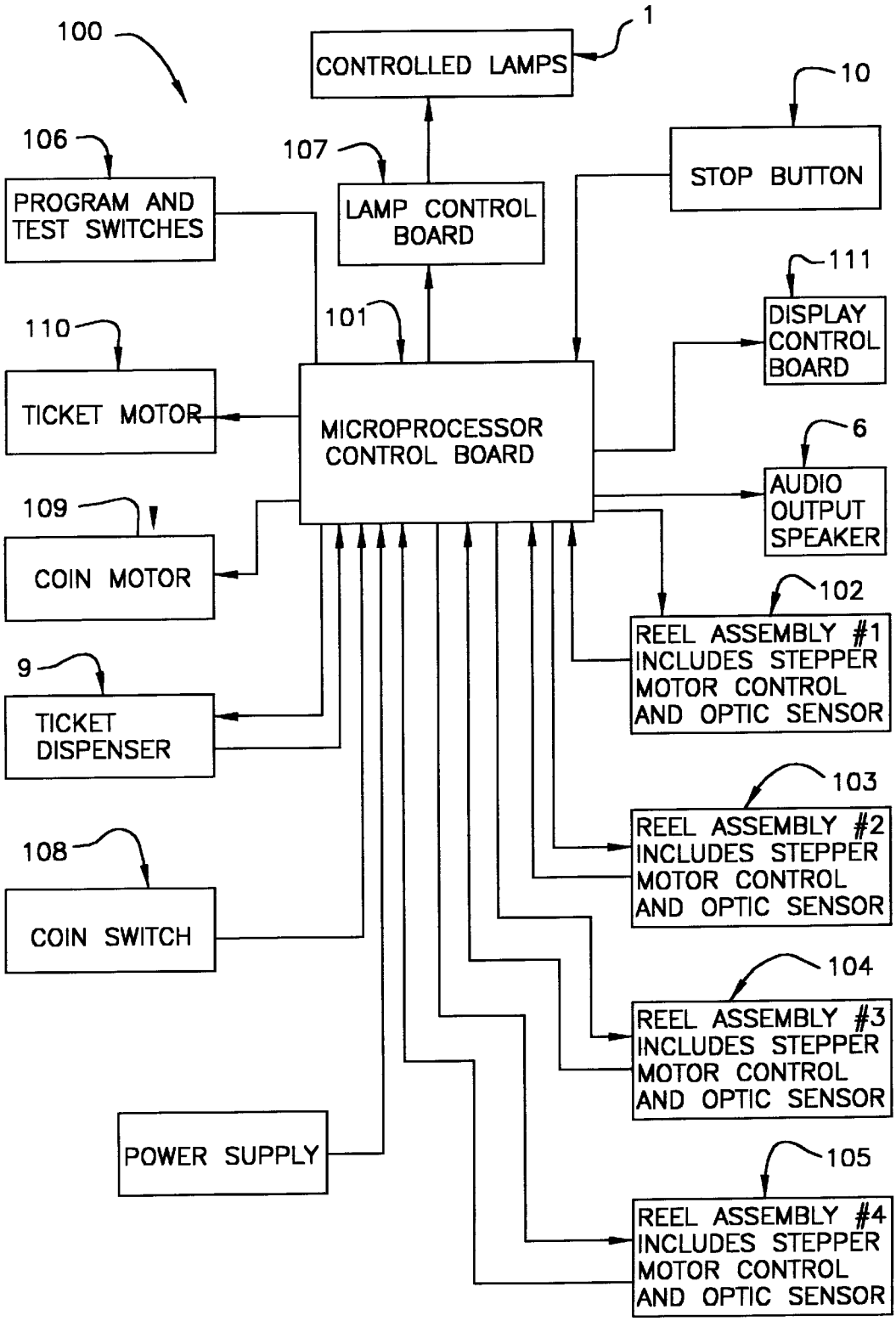
FIG. 2 is a block diagram which illustrates the structural relation of the hardware as recited with reference to the embodiment of the player activated matching jackpot device as shown in FIG. 1.

A microprocessor or central processing unit (C.P.U.), which is shown as block 101, in FIG. 2, is also arranged within housing 80 of player activated matching jackpot device 11. It is understood that the microprocessor may be connected externally as well. FIG. 2 illustrates a block diagram of a hardware system 100 for operating the player activated machine jackpot device 11, in accordance with one embodiment of the invention, although the invention is not limited in scope in that respect. Microprocessor 101 is configured to control and operate different components of the system by employing its input and output ports as explained hereinafter.

Four reel assemblies 102–105 are coupled to both input and output ports of the microprocessor and each are further coupled to respective reel devices 2–5. Each reel assembly operates as a microprocessor input/output driver unit for controlling the operation of reel devices 2–5, and includes a stepper motor control board and an optic sensor for tracking the position of the corresponding reel band. As will be explained in more detail, the microprocessor can signal a reel assembly to in turn spin its respective reel device to different characters and the reel assembly can additionally notify the microprocessor which character is currently visible on a particular reel device. Coupled to another output port of microprocessor 101 is a lamp control board 107, which receives signals from microprocessor 101 and in turn is configured to turn on or off a specific character lamp or reel lamp.

Referring to FIG. 2 stop button 10 is coupled to an input port of microprocessor 101 to signal user input. During game play a stop signal is received by microprocessor in response to the pressing of the stop button, as described in more detail in reference with FIG. 4.

In accordance with one embodiment of the invention, hardware system 100 includes other components that may further enhance the operation of the system. For example, a coin switch 108 provides a signal to another input terminal of microprocessor 101 upon insertion of a coin into the amusement device. Also, as will be explained in more detail hereinafter, microprocessor 101 is coupled to various output devices in order to commence certain display updates, turn on various lights, and play music. For example, after a coin is initially inserted or after stop button 10 is pressed, microprocessor 101 provides audio signals to audio output speaker 6. Microprocessor 101 also provides a signal to a coin meter 109 which records and tracks the number of tokens which have been inserted.

Each of the reel devices 2–5 is configured to rotate via a spinning axle of a stepper motor (not shown). Input terminals of the stepper motors are coupled to the output terminals of a corresponding reel assembly which includes a stepper motor control board. The operation of a stepper motor is well known. Briefly, a stepper motor includes a rotor that is a permanent cylindrical magnet with many poles around its circumference. The rotor rotates inside two set of stator coils, each of which has a row of metal teeth. As stepper motor control board sends an excitation signal to a stator coil, the metal teeth become magnetized with alternate north and south poles. Reversing the excitation signal, reverses the sequence of the poles. The rotor travels a predetermined distance every time it receives and excitation signal. As a result, microprocessor 101 is configured to track the distance traveled by a reel band in view of the signals sent to the stepper motor. This distance is advantageously stored in a distance traveled register. In order to measure the distance from a predetermined reference point on the reel device, a solid marker is disposed on the reel device so that the distance traveled is set to zero every time the solid marker passes by a wheel position optic sensor.

As explained above, wheel optic sensor is disposed adjacent reel device and provides a marker indication signal to microprocessor 101 every time the solid marker on reel device passes by it. In response to this marker indication signal, microprocessor 101 resets the distance traveled register to stepper motor. Thus, as the stepper motor rotates the reel device, microprocessor 101 tracks the distance traveled in relation to the location of the reel position optical sensor.

Figure 3:
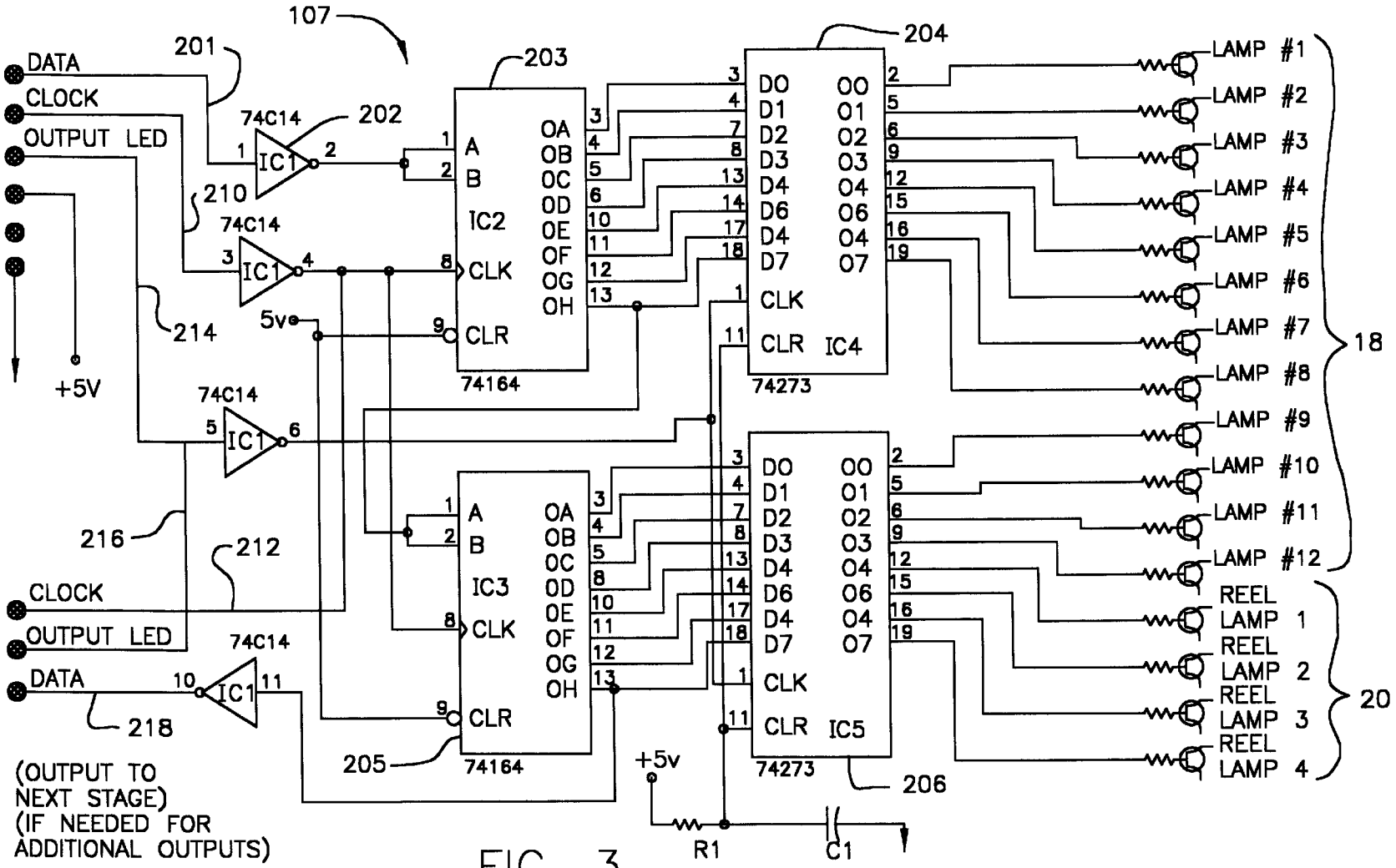
FIG. 3 is a schematic diagram of the lamp control board shown in FIG. 2 according to one embodiment of the present invention.

FIG. 3 is a block diagram of lamp control board 107 in accordance with one embodiment of the invention, although the invention is not limited in scope in that respect. Microprocessor 101 is coupled to a shift register 203 via a lamp data line 201 and an inverter 202. Thus, shift register 203 is configured to receive a serial sequence of pulses that correspond to the desired light to be lit. The output ports of shift register 203 are coupled to the input ports of a data latch 204. The output ports of data latch 204 are in turn coupled to a plurality of the lamps employed by jackpot device 11. In one embodiment of the invention, shift register 203 and data latch 204 include eight output ports. Thus, data latch 204 is configured to provide an activation signals to a group of eight lamps, such as character lamps 1–8.

One of the output ports of shift register 203 is coupled to a data input port of a second shift register 205. Shift register 205 is employed to accommodate lamp control data received from microprocessor 101 having a 16-bit length. The output ports of shift register 205 are in turn coupled to a second data latch 206. The output ports of data latch 206 are in turn coupled to a second group of lamps that are employed by jackpot device 11. Shift registers 203 and 205 are configured to send or receive clock signals via clock lines 210 and 212. Furthermore, data latches 204 and 206 are configured to send or receive output latch indication signals via lines 214 and 216. In response to an output latch indication signal, each data latch 204 and 206 provides its stored data to the lamps.

It is appreciated by those skilled in the art that when additional lamps are desired the arrangement illustrated in FIG. 3 may be repeated by connecting the last pin of shift register 205 via a data line 218 to a next shift register in the following stage. Furthermore, it is also noted that the arrangement for activating lamps as described herein with reference with FIG. 3 is one example and other well know arrangements may be employed.

Referring to FIG. 3, during operation, microprocessor 101 transmits a serial sequence of pulses corresponding to a 16-bit word to lamp control board 107. Shift registers 203 and 205 receive this sequence and provide a 16-bit word in parallel format to data latches 204 and 206. The data latches provide lamp activation signals after the 16-bit word has been made available to them so as to illuminate a set of desired lamps in an order as specified by microprocessor 101.

Microprocessor 101 is also configured to receive signals from program and test switches 106. Device 11 is advantageously in a "non-error" or normal mode when playing. Program and test switches 106 are monitored by microprocessor 101 and when they are activated while the game is in a "non error" mode, they put the game into a "programming and bookkeeping mode." The "programming and bookkeeping mode" allows the operator of the game to set up the values that the game will award for each of the possible outcomes, as will be discussed infra in more detail, and also keeps track of player and score history. If the game is in an "error condition," for example, when the device has depleted its ticket supply, or if the microprocessor 101 does not detect one of the solid markers passing over the optic sensor in the appropriate amount of time, an error code may be displayed. When the error is corrected, the operator of the game can activate the program and test switches to return to the "non-error" or normal mode of operation.

As the game is played and points are accumulated, microprocessor 101 provides signals to display control board 111, which controls jackpot display 8 (shown in FIG. 1). In this embodiment jackpot display 8 is configured to display the current jackpot value. In another embodiment jackpot display 8 can be configured to potentially display the character "7" in each of its three LED characters. As will be explained in more detail, when the player successfully triggers stop button 10 as to select the character "7", from the twelve characters, microprocessor 101 responds by displaying the character "7" on the first unused character of jackpot display 8, and so forth until all three LED characters are used or game play ends, whereas the jackpot display 8 is reset by the microprocessor. The term "jackpot" is used to correspond with the highest achievable score during game play, which is successfully obtaining three character "7"'s. In one embodiment a predetermined response, such as a display of lights and music can be triggered in response to a player successfully achieving a "jackpot." In an alternative embodiment the jackpot can be assigned to a different character or the LED display 8 can be used for other scoring displays, such as the number of points scored or tickets earned during game play.

As the player accumulates points the microprocessor tracks the number of tickets earned during game play and appropriately signals an input port of ticket dispenser 9 to dispense a specified number of tickets. In addition, ticket dispenser 9 can also output a signal to an input port of microprocessor 101 when the dispenser is empty or jammed. Depending upon the configuration of the microprocessor 101 this may cause the game to enter an "error mode" and halt further play, or notify player that ticket dispenser 9 is not operational. In this embodiment a software mechanism is used to detect an empty or jammed ticket dispenser, rather than the direct hardware method mentioned above. Illustratively, an optical sensor (not shown) located on ticket dispenser 9 senses a ticket notch each time a ticket is dispensed. The microprocessor, upon receiving a signal from the sensor, reduces the value of a ticket counter register (not shown) by one, to account for the dispensed ticket. If the ticket counter register is reduced to zero or a ticket notch is not detected by the optical sensor for a predetermined period of time, the game enters the error mode detailed above. Advantageously, the microprocessor stores into a ticket meter register 110 the total number of tickets dispensed so that a game operator has an indication of how many tickets were paid out to players.

Figure 4:
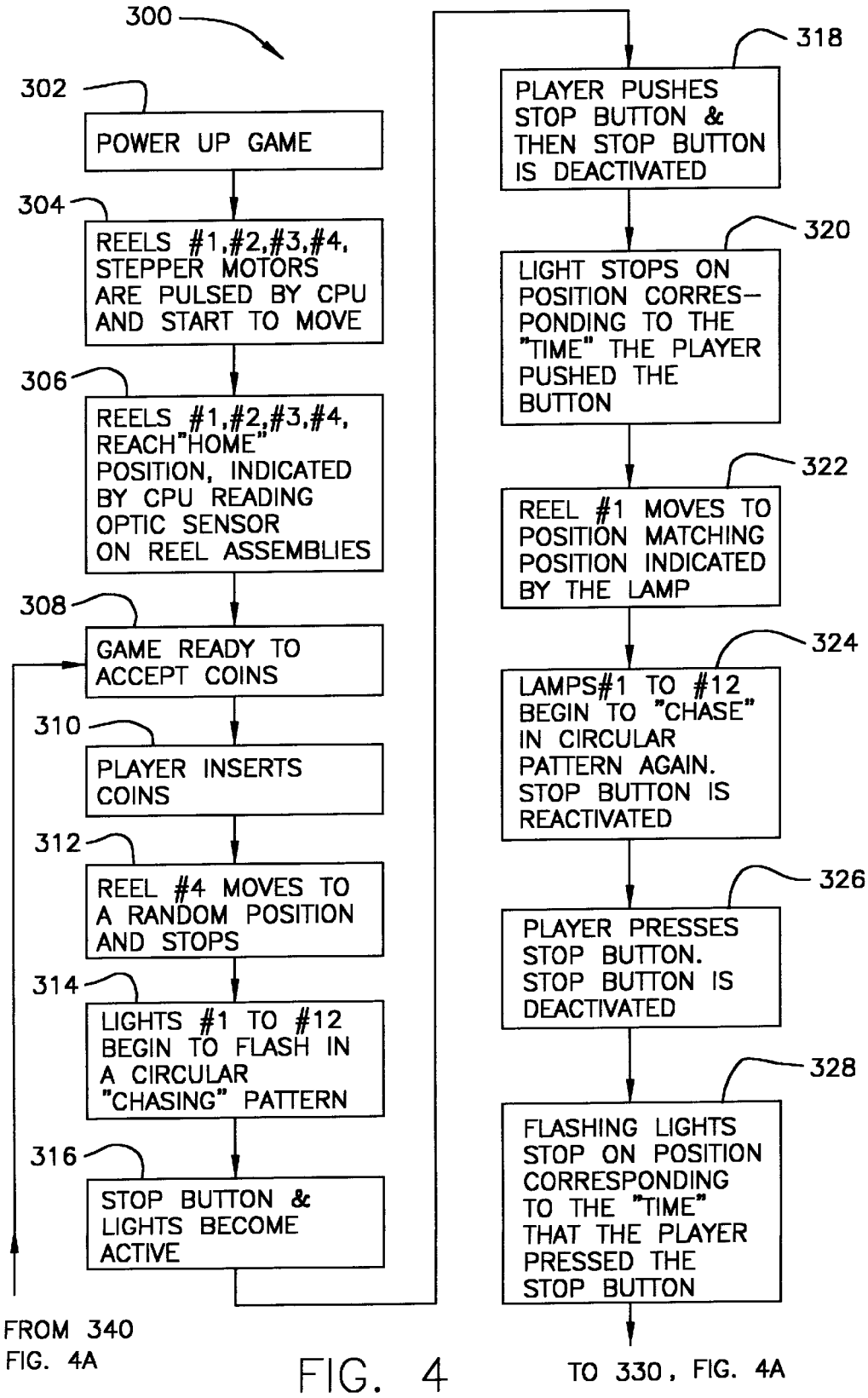
FIG. 4 is a flow diagram which illustrates the sequence of operation of the main program loop according to one embodiment of the present invention.
Figure 4A:
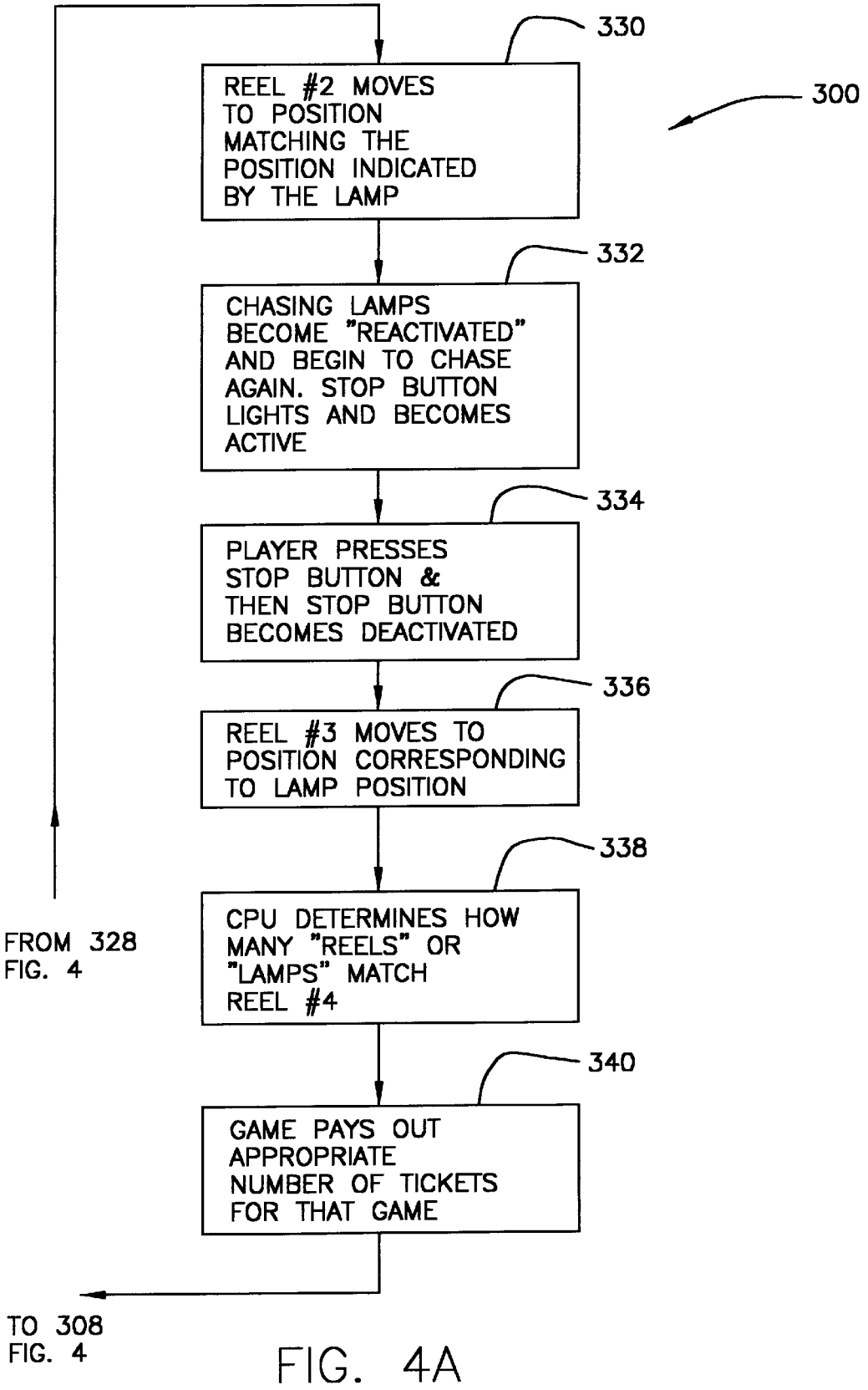

Main program loop 300 illustrated in FIG. 4 describes the steps employed in operating jackpot device 11, according to one embodiment of the present invention. Main program loop 300 consists of three modes. A startup mode comprising of steps 302–306, begins at step 302 upon system power up. At step 304 reel devices begin to move in response to the microprocessors control signals. At step 306 the microprocessor resets the jackpot display, clears specified registers, and positions each of the reel devices at their "home" position. In addition to power up, an optional reset button can be included with jackpot device to automatically send the program loop 300 to startup mode 301 at any point in the main program loop 300. Upon concluding the startup mode the microprocessor then enters an attract mode loop 308. In attract mode loop 308 the jackpot device, for example, continuously repeats specified tasks, such as playing music, turning on lights or even simulating a sample game play environment. The intent of this stage is both to attract individuals to play the game and occupy the system prior to actual game play. The jackpot device continuously loops in "attract mode" until a player inserts a coin at step 310 or triggers the jackpot device in another specified manner, causing the third stage, play mode, comprising the steps 310–340, to commence.

According to one embodiment, the microprocessor initiates "play mode" by spinning the "object character" reel device 2 to a randomly selected object character at step 312; at the same time, the reel lamp for that device may be optionally turned on for clarity. Thereafter at step 314, the twelve character lamps 18 begin to quickly flash on and off sequentially in a circular "chasing" pattern, such that only one of the twelve character lamps is activated at any instant. Stop button 10 may additionally have a light which turns on for the entirety of this step, indicating that user input is desired at step 316. The flashing and active character lamps from steps 314 and 316 continue until step 318 where the player presses and deactivates stop button 10 or microprocessor reaches a predetermined time limit and automatically deactivates stop button 10. Upon deactivating the stop button, microprocessor instantly halts the circular "chasing" pattern and the one of the twelve character lamps which was lit at that particular instant remains lit at step 320. Thereafter, at step 322, the first of the three horizontal reels moves to the first game character, corresponding to the character matching the one lit character lamp. Stop button 10 is reactivated and the circular "chasing" pattern resumes at step 324, until the stop button is again deactivated at step 326. Upon this deactivation the second horizontal reel moves to the second game character at step 330, corresponding to the activated character lamp when the player presses the stop button at step 328. This mini-loop continues a third time, at steps 332–336, until all three horizontal reel devices have been assigned a particular character. The microprocessor then calculates a predetermined score based on the combination of all three selected characters at step 338 and appropriately dispenses tickets or tokens as an award at step 340. Depending on the configuration, points can be awarded for successfully obtaining three identical characters or any other desired combination. A successful combination may involve matching the object character of the object character reel device. In an alternative embodiment, the object character reel device may spin to an object character at the end of game play to award bonus points to individuals luckily matching this character, unknown during game play.

In one embodiment, the highest score, or jackpot, is achieved by obtaining three jackpot character "7"'s. As described above the jackpot display 8 displays the character "7" on each of its three LED characters responding to the number of character "7"'s obtained by the player. As an alternative, the microprocessor can be configured to assign the jackpot character to another character or automatically assign for each game the randomly selected object character as the jackpot character.

Completion of the "play mode" loop causes the microprocessor to return to the "attract mode" loop 308. It is understood that the main program loop can be adjusted to alternate the style of game play. For example, the top reel device can also be selected by the player rather than randomly assigned and the sequential circular "chasing" pattern of the character lamps can be mathematically based to stimulate players to discover the appropriate pattern, or even randomized to add confusion.

Figure 5:
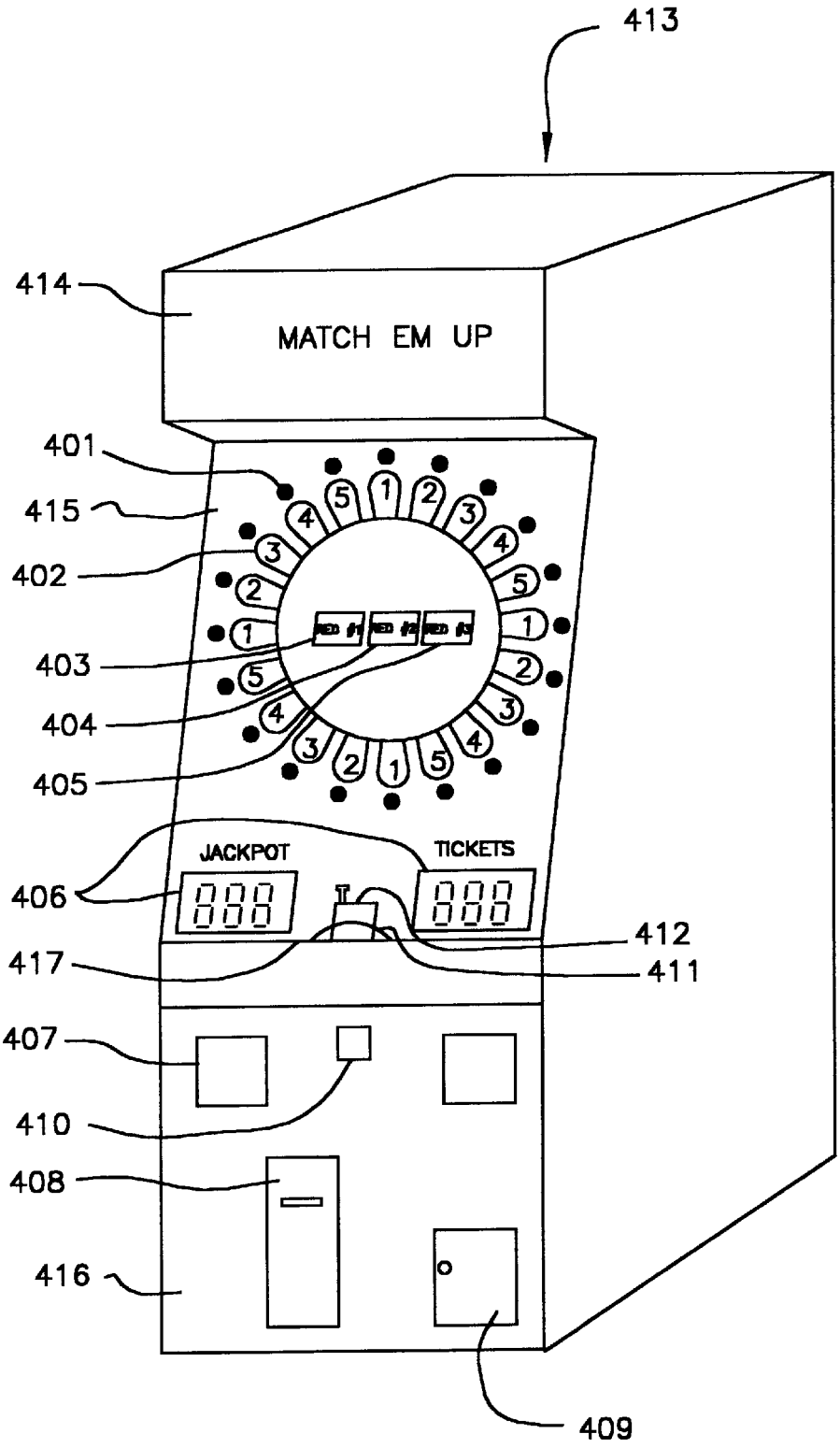
FIG. 5 illustrates a front perspective view of a second embodiment of the player activated matching jackpot device of the present invention.

According to a second embodiment of the invention certain modifications and additions are made to the structure of the first embodiment of FIG. 1. As shown in FIG. 5 this player activated matching jackpot device 11 is comprised of a rectangular housing 413 having a vertical front face 415, a vertical top 414, and a vertical bottom front 416. The vertical bottom front 416 is also extended forward a measurable distance to enable a horizontal user platform 417 to be placed, connecting top of bottom front with bottom of front face.

Rather than twelve character lamps 18 illuminating twelve unique character displays 1, as in FIG. 1, this embodiment has twenty character lamps (not shown) illuminating five unique character displays 402. The characters are repeated four times around a circular diameter. An outer indication lamp 401, is disposed next to each one of the five character displays 402 in a circular pattern. These outer indication lamps are also connected to a lamp control board (not shown) and can be used during game play to illuminate a particular lamp, giving the player an indication which character is needed to score the most points or match a previously selected game character.

In accordance with one embodiment there are three reel devices 403–405, each spinning, during game play, to the respective character selected by player when stop button 411 is pressed. It is understood that the number of rounds a player is allowed to press the stop button can be increased, as well as the number of reel devices. Further, two LED character displays 406 and corresponding display control boards are included. This enables the jackpot device to have both a jackpot display, which can output the jackpot characters or jackpot value, as mentioned before, and a ticket display, which outputs the score or number of tickets earned. As in the first embodiment, this jackpot device also contains a stop button 411, coin entry 412, coin return 410, speakers 407, ticket dispenser 408, and cash door 409.

Main program loop (not shown) of this embodiment is based on the same principal of operation as that of the first embodiment 300. Upon receiving a coin, or being initiated in another manner, the play mode loop of this embodiment commences. The twenty character lamps begin to quickly flash on and off sequentially in a circular "chasing" pattern, continuing until the stop button is pressed and deactivated. Thereafter, the first game character reel device spins to the selected character and the outer indication lamp adjacent to the character display of the selected character turns on and remains lit until the end of the play mode loop. This outer indication lamp is intended to be an indication light to aid the player during game play. As the optimal score is achieved by selecting the same character repeatedly, the outer indication lamp enables the player to more easily keep track of the character he or she needs to select in the following rounds. The character lamps begin to quickly flash on and off again, repeating the above steps for multiple rounds of game play; in this embodiment there are three rounds. Thereafter, the microprocessor calculates a predetermined score based on the combination of all three characters and appropriately dispenses tickets or tokens as an award.

It is to be understood that the present invention is not limited to the embodiments as described hereinabove. In an alternative embodiment a digital character display, such as a digital computer screen or a liquid crystal display (LCD), may be added, to display digital characters that are not fixed to one location, unlike the aforementioned character displays, enabling these digital characters to additionally switch from one location to another during game play. Neither does this invention require character lamps, as individual character displays may be activated by different illumination devices or any other visual cue device, in addition to illumination. For example, the character displays may contain shutter doors 89 (FIG. 1), which open and shut one at a time. Thus, an open shutter door corresponds to a visually cued character display, similar to the manner in which the character lamps turn on and off. Also, there may be indication units that physically move or change color to notify the player which character display is activated and may be selected at any given instant during game play.

Moreover, in another embodiment, a color display, such as color lamp 20 (FIG. 1), is additionally included on housing 80 of the jackpot device, to slightly modify the style of the game. The color display is configured to display one of a plurality of colors at any given instant and during game play may signal the microprocessor to execute a particular task, such as to alter the arrangement of characters on a digital character display. Main program loop (not shown) of this embodiment is based on the same principal of operation as that of the first embodiment 300. Upon receiving a coin, or being initiated in another manner, the play mode loop of this embodiment commences. The plurality of character lamps begin to quickly flash on and off sequentially in a circular "chasing" pattern, as described above. In addition, color lamp 20 also flashes, alternating between a plurality of colors, both the color lamp and character lamps continuing until the stop button is pressed and deactivated. Thereafter, the microprocessor responds accordingly, based on the combination of the selected character and the color that was illuminated on the color lamp at the instant the stop button was pressed.

For example, one color could signal the microprocessor to normally display the selected character on a game character reel device, as in previous embodiments. Another could increase the frequency of the selected character, on a digital character display, so that during the following round there will be more instances of that character to select with the stop button, increasing the odds of selecting the same character again. Yet another color could reward the user player causing the microprocessor to display one selected character on two game character reel devices, increasing the odds of winning. In response to the increased reward offered by certain colors, an element of risk can be added, such as a "danger zone," where certain combinations of colors and characters, if selected, instantly terminate game play or deduct points. To increase the challenge or desirability an additional stop button may be included to allow the player, at each round of game play, to choose whether to incorporate the color lamp into the game. One button may normally select the activated character, as in the first embodiment, while the other button selects both the activated character and activated color, whereas the microprocessor calculates the appropriate response. Furthermore, the color lamp may be placed at multiple locations on housing 80, to illuminate the entire jackpot device as one color, enabling the player to focus on the character displays without losing sight of the color lamp.

Thus, while there have been shown and described and pointed out fundamental novel features of the invention as applied to alternative embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto. It is to be understood that the drawings are not necessarily drawn to scale, but that they are merely conceptual in nature.

What is claimed is:

1. A player activated matching jackpot device comprising:

a plurality of selectable character displays, wherein said character displays are each disposed on a panel of said jackpot device;

a plurality of moveably activated visual cue devices, wherein said visual cue devices are activated to visually cue said character displays in accordance with a plurality of predetermined patterns so that an activated visual cue device is configured to visually cue a corresponding character display disposed on said panel;

a stop button for selecting a visually desired one of said character displays when a visual cue device corresponding to said desired character display is activated;

a plurality of game character reel devices, having a corresponding reel band to display each of said characters sequentially, each of said game character reel devices displaying a selected character in response to signals received from said stop button; and a microprocessor for receiving a plurality of signals from said stop button, each of said signals indicating a selected character corresponding to a visually cued character display at the time when said stop button is activated, said microprocessor providing an award based on a combination of display characters selected through said signals.

2. The player activated matching jackpot device as recited in claim 1, further comprising an object character reel device having a reel band that displays a selected object character, and said award is calculated relative to said combination of game characters matching said object character in response to said signals from said stop button.

3. The player activated matching jackpot device as recited in claim 2, wherein said game character reel devices and said object character reel device are each coupled to a reel assembly.

4. The player activated matching jackpot device as recited in claim 3, wherein said reel assembly further comprises:

a stepper motor control board configured to provide an excitation signal in order to rotate said game character reel devices and said object character reel device to a predetermined distance;

an optic sensor disposed adjacent each of said game character reel devices and object character reel device for providing a marker indication signal to said microprocessor every time a solid marker on a corresponding reel device passes by said optic sensor.

5. The player activated matching jackpot device as recited in claim 1, whereas said plurality of visual cue devices is a plurality of character lamps and said visually cued character display is an illuminated character display.

6. The player activated matching jackpot device as recited in claim 5 further comprising a lamp control board, said lamp control board coupled to said microprocessor so that said character lamps can be activated and deactivated as specified by said microprocessor.

7. The player activated matching jackpot device as recited in claim 1, whereas said plurality of visual cue devices is a plurality of shutter doors and said visually cued character display is an open character display.

8. The player activated matching jackpot device as recited in claim 1, wherein said visual cue devices further comprise an outer indication lamp for providing an indication light during game play.

9. The player activated matching jackpot device as recited in claim 1, further comprising a color display for displaying one of a plurality of colors, whereas said stop button selects said visually cued character display and a displayed color, and said microprocessor provides a response based on a combination of said displayed color and said visually cued character display.

10. The player activated matching jackpot device as recited in claim 1, wherein said jackpot device is positioned within a housing, said housing having a front face comprising a translucent plate such that said jackpot device is visible through said front face.

11. The player activated matching jackpot device as recited in claim 1, further comprising a coin entry and coin return, said coin entry configured to activate said jackpot device upon sensing a predetermined quantity of coins.

12. The player activated matching jackpot device as recited in claim 1, wherein said award is a plurality of tickets dispensed from a ticket dispenser configured to said microprocessor.

13. The player activated matching jackpot device as recited in claim 1, wherein said jackpot device further comprises a plurality of output displays to output scores, and tickets earned.

14. The player activated matching jackpot device as recited in claim 13, wherein said output displays are LED character displays.

15. The player activated matching jackpot device as recited in claim 1, wherein said plurality of character displays is positioned in a vertical plane.

16. The player activated matching jackpot device as recited in claim 1, wherein said plurality of character displays is positioned in a horizontal plane.

17. A player activated matching jackpot device comprising:

a plurality of selectable character displays, wherein said character displays are each disposed on a panel of said jackpot device;

a plurality of moveably activated visual cue devices, wherein said visual cue devices are activated to visually cue said character displays in accordance with a plurality of predetermined patterns so that an activated visual cue device is configured to visually cue a corresponding character display disposed on said panel;

a controller configured to employ said activation of said visual cue devices so as to visually cue said character displays in accordance with a plurality of predetermined patterns;

a stop button for selecting a visually desired one of said character displays when said visual cue device corresponding to said desired character display is activated; and a plurality of game character reel devices, having a corresponding reel band to display each of said characters sequentially, each of said game character reel devices displaying a selected character in response to signals received from said stop button.

18. The player activated matching jackpot device as recited in claim 17, further comprising a microprocessor for providing an award based on a combination of game characters selected by said stop button.

19. The player activated matching jackpot device as recited in claim 17, wherein said plurality of visual cue devices is a plurality of character lamps, said visually cued character display is an illuminated character display, and activation of a visually cued device is accomplished through a microprocessor configured lamp control board.

20. The player activated matching jackpot device as recited in claim 18, wherein said plurality of game character reel devices further comprise:

spinning means for spinning said plurality of game character reel devices; and sensing means adjacent each of said game character reel devices for sensing a home position on one of said game characters reel devices for notifying said microprocessor position of said one game character reel devices.

21. The player activated matching jackpot device as recited in claim 20, wherein said spinning means is accomplished with a stepper motor rotating via a spinning axle.

22. The player activated matching jackpot device as recited in claim 20, wherein said sensing means is an optic sensor.

23. A method for operating a player activated matching jackpot device, comprising the steps of:

(a) visually cueing a plurality of selectable character displays at least one at a time in accordance with a plurality of predetermined patterns, wherein said character displays are each disposed on a panel of said jackpot device;

(b) pressing a stop button, so as to select one of said visually cued character displays;

(c) spinning a game character reel devices, having a corresponding reel band, to display on of said character corresponding to said visually cued character (d) selecting a combination of game characters by repeating steps (a) and (b); and (e) awarding a prize corresponding to the combination of game characters selected.

24. The method as recited in claim 23, wherein said cueing step further comprises the step of illuminating an outer indication lamp corresponding to a character display.

25. The method as recited in claim 23, wherein said awarding step further comprises the step of dispensing a number of tickets or coins corresponding to said point value of said combination of game characters.

* * * * *